US006669745B2

(12) United States Patent
Prichard et al.

(10) Patent No.: US 6,669,745 B2
(45) Date of Patent: Dec. 30, 2003

(54) ABRASIVE ARTICLE WITH OPTIMALLY ORIENTED ABRASIVE PARTICLES AND METHOD OF MAKING THE SAME

(75) Inventors: Paul D. Prichard, Woodbury, MN (US); Kyung H. Moh, Woodbury, MN (US); David C. Koskenmaki, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 70 days.

(21) Appl. No.: 09/790,145

(22) Filed: Feb. 21, 2001

(65) Prior Publication Data

US 2003/0009949 A1 Jan. 16, 2003

(51) Int. Cl.[7] ..... B24D 3/00; B24D 3/06; B24D 11/00

(52) U.S. Cl. ..... 51/297; 51/295; 51/307; 51/308; 51/309; 51/293

(58) Field of Search ..... 51/297, 295, 307, 51/308, 309, 293; 156/230, 276, 279; 427/272, 282, 287

(56) References Cited

U.S. PATENT DOCUMENTS

| | | | |
|---|---|---|---|
| 4,047,902 | A | 9/1977 | Wiand |
| 4,680,199 | A | 7/1987 | Vontell et al. |
| 4,925,457 | A | 5/1990 | deKok et al. |
| 5,049,165 | A | 9/1991 | Tselesin |
| 5,092,910 | A | 3/1992 | deKok et al. |
| 5,190,568 | A | 3/1993 | Tselesin |
| 5,203,880 | A | 4/1993 | Tselesin |
| 5,380,390 | A | 1/1995 | Tselesin |
| 5,453,106 | A | 9/1995 | Roberts |
| 5,525,100 | A | 6/1996 | Kelly et al. |
| 5,551,960 | A | 9/1996 | Christianson |
| 5,560,745 | A | 10/1996 | Roberts |
| 5,620,489 | A | 4/1997 | Tselesin |
| 5,695,533 | A | 12/1997 | Kardys et al. |
| 5,725,421 | A | 3/1998 | Goers et al. |
| 5,791,330 | A | 8/1998 | Tselesin |
| 5,817,204 | A | 10/1998 | Tselesin |
| 5,980,678 | A | 11/1999 | Tselesin |
| 6,039,641 | A | 3/2000 | Sung |
| 6,096,107 | A | 8/2000 | Caracostas et al. |
| 6,110,031 | A | 8/2000 | Preston et al. |
| 6,159,087 | A | 12/2000 | Birang et al. |
| 6,286,498 | B1 | 9/2001 | Sung |

FOREIGN PATENT DOCUMENTS

| | | |
|---|---|---|
| EP | 1 122 030 A2 | 8/2001 |
| GB | 2 326 166 A | 12/1998 |
| WO | WO 96/09140 | 3/1996 |

OTHER PUBLICATIONS

N. Tselesin, *Improvements of Diamond Tools for Machining of Advanced Engineered Ceramics* in "Using Advanced Ceramics in Manufacturing Applications," Conference Paper, Jun. 3–5, 1991, Cincinnati, OH, Publication of Society of Manufacturing Engineers, p. EM91–248–3.

*Primary Examiner*—Michael Marcheschi
(74) *Attorney, Agent, or Firm*—Bradford B. Wright

(57) ABSTRACT

The invention provides abrasive articles with optimally oriented abrasive particles and a method of making the same. The method involves contacting a substrate with the contact and mating surfaces of tools to provide an embossed substrate with perforated depressions, distributing abrasive particles within the depressions of the substrate, optimally orienting each abrasive particle in the depression containing the abrasive particle, creating a differential pressure between the top surface and the back surface of the embossed, perforated sheet wherein a lower pressure is applied to the back surface to hold the oriented abrasive particles within its depression while removing at least a major portion of abrasive particles not within the depressions from the top surface of the sheet and permanently bonding the abrasive particles in the depressions after they are optimally oriented to provide the abrasive product.

30 Claims, 6 Drawing Sheets

ABRASIVE ARTICLE WITH OPTIMALLY ORIENTED ABRASIVE PARTICLES AND METHOD OF MAKING THE SAME

BACKGROUND

This invention relates to abrasive articles having oriented abrasive particles in a matrix and to a method of making such abrasive articles.

There are many prior methods disclosed for incorporating and positioning certain types of abrasive particles in a sheet-like matrix. Such abrasive particles include diamond crystals and crystalline cubic boron nitride (CBN). Each of these abrasive materials is known to provide optimal abrasive performance when the abrasive particles are optimally positioned in the matrix which holds them in the abrasive product. Various attempts have been made to optimally position such abrasive particles in such abrasive products, but they have met with only limited success in the optimal orientation of abrasive particles. The following references provide some indication of what has been done in the past to provide a solution to this problem.

U.S. Pat. No. 4,680,199 (Vontell); U.S. Pat. Nos. 4,925,457 and 5,092,910 (de Kok); U.S. Pat. No. 5,525,100 (Kelly); U.S. Pat. No. 5,725,421 (Goers); U.S. Pat. No. 5,551,960 (Christianson); U.S. Pat. No. 5,049,165 (Tselesin); U.S. Pat. No. 5,380,390 (Tselesin); U.S. Pat. No. 5,620,489 (Tselesin); U.S. Pat. No. 6,110,031 (Preston); U.S. Pat. No. 5,791,330 (Tselesin); U.S. Pat. No. 5,695,533 (Kardys); U.S. Pat. No. 5,817,204 (Tselesin); U.S. Pat. No. 5,980,678 (Tselesin); N. Tselesin, *Improvements of Diamond Tools for Machining of Advanced Engineered Ceramics* in "Using Advanced Ceramics in Manufacturing Applications," Conference Paper, Jun. 3–5, 1991, Cincinnati, Ohio, Publication of Society of Manufacturing Engineers, p. EM91-248-3; U.S. Pat. No. 5,190,568 (Tselesin); U.S. Pat. No. 5,203,880 (Tselesin); and U.S. Pat. Nos. 5,560,745 and 5,453,106 (Roberts).

SUMMARY OF THE INVENTION

The present invention resides in the discovery of a deficiency in what the art has taught in regards to making abrasive products having optimally oriented shaped abrasive particles. The present invention produces an abrasive product with optimally oriented shaped abrasive particles to provide optimal orientation and alignment of the sharp points of the abrasive particles for effective abrading irrespective of crystallographic orientation.

For the purpose of this invention "optimal orientation" refers to the preferred orientation desired by the manufacturer or user of the abrasive product. Optimal orientation may not always include completely erect abrasive particles should some other orientation be desired. The present invention provides a method in which substrates containing tapered or otherwise shaped surface perforated depressions (e.g., square pyramidal or conical) are used to capture and orient individual abrasive particles thereby increasing the probability of a sharp edge or point being deployed in contact with the surface of a workpiece. The shape of the depression is such that it inherently deploys the abrasive particle in an optimal orientation. The substrate within each shaped depression has a perforation which further facilitates the deployment of the abrasive particle contained therein which may permit reducing the pressure on the back side of the substrate. This technique allows the abrasive particles to arrange themselves with points or edges in a desired configuration, e.g., pointing up.

In one aspect the invention provides a method of making an abrasive article comprised of a sheet-like matrix having deployed therein a multiplicity of optimally oriented shaped abrasive particles, each abrasive particle having a shaped base end and an opposite shaped abrading end comprising:

providing a substrate forming apparatus including a first tool having a contact surface including a multiplicity of projections and a second tool having a mating surface, the contact and mating surfaces of said tools, when mated, being capable of deforming said substrate to provide perforated depressions in the substrate capable of receiving in each depression one base end of said abrasive particle and optimally orienting the abrasive particle therein;

providing an embossable, perforatable, sheet-like substrate;

contacting the sheet-like substrate with the contact and mating surfaces of said first and second tools to provide an embossed, perforated, sheet having back surface and an opposite top surface characterized by having a multiplicity of depressions wherein each depression is characterized by having a shape capable of receiving the shaped base end of said shaped abrasive particle and optimally orienting the abrasive particle therein and a perforation through the sheet-like substrate within said depression wherein the perforation is of a size which will not permit the passage of said abrasive particle;

distributing abrasive particles within said depressions substantially with one abrasive particle in each depression of the embossed, perforated sheet;

optimally orienting each abrasive particle in the depression containing the abrasive particle;

creating a pressure differential between the top surface and the back surface of said embossed, perforated sheet wherein a lower pressure is applied to the back surface to hold each oriented abrasive particle within its depression while removing at least a major portion of the abrasive particles not within said depressions from the top surface of said embossed, perforated sheet; and permanently bonding said abrasive particles in said depressions after they are optimally oriented to provide an abrasive product which includes optimally oriented shaped abrasive particles with abrading ends exposed.

In a further aspect wherein the substrate is sinterable, the invention provides a method of making an abrasive article comprised of a sheet-like matrix having deployed therein a multiplicity of optimally oriented shaped abrasive particles, each abrasive particle having a shaped base end and an opposite shaped abrading end. The method comprises:

providing a substrate forming apparatus including a first tool having a contact surface including a multiplicity of projections and a second tool having a mating surface, the contact and mating surfaces of said tools, when mated, being capable of deforming said substrate to provide perforated depressions in the substrate capable of receiving in each depression one base end of the abrasive particle and optimally orienting the abrasive particle therein;

providing an embossable, perforatable, sinterable sheet-like substrate comprised of sinterable particles and organic binder in a layer borne on a metal foil;

contacting the sheet-like substrate with the contact and mating surfaces of said first and second tools to provide an embossed, perforated, sinterable sheet having back surface provided by said metal foil and an opposite top surface characterized by having a multiplicity of depressions wherein each depression is characterized by having a shape capable of receiving the shaped base end of said shaped abrasive particle and optimally orienting the abrasive particle therein and a perforation through the sheet-like substrate within said depression wherein the perforation is of a size which will not permit the passage of said abrasive particle;

distributing abrasive particles within said depressions substantially with one abrasive particle in each depression of the embossed, perforated, sinterable sheet;

optimally orienting each abrasive particle in the depression containing the abrasive particle;

creating a pressure differential between the top surface and the back surface of said embossed, perforated, sinterable sheet wherein a lower pressure is applied to the back surface to hold each oriented abrasive particle within its depression while removing at least a major portion of the abrasive particles not within said depressions from the top surface of said embossed, perforated, sinterable sheet;

temporarily bonding said abrasive particles in said depressions after they are optimally oriented;

heating the abrasive particle bearing embossed, perforated, sinterable sheet at a sintering temperature to provide on cooling an abrasive product which includes a sintered matrix bearing bonded optimally oriented shaped abrasive particles with abrading ends exposed; and cooling said abrasive product.

The preferred method is where the contact and the mating surfaces of said tools are each borne on a surface of a roller. The mating surface may be of a particular shape to provide the depressions or it may simply be a flexible sheet having a smooth surface such as a sheet of elastomeric material.

The term "sinterable sheet" refers to a green sheet comprised of a preformed sheet of heat fusible particles which typically melt on heating (e.g., metal particles) in a temporary organic binder. Such sinterable materials for the purpose of the present invention include brazing compositions. The preferred sinterable layer comprises metal particles and an organic binder and/or a brazing composition. Such a brazing composition may be an active metal braze. Suitable brazing compositions are preferably selected from Ni—Cr—Si, Ni—Cr—P, Ni—Cr—B, Ni—Cr—Si—B, Cu—Sn, Ag—Cu and Ni—Si—B alloys.

The sinterable layer provides on heating to the sintering temperature a liquidus phase in a volume sufficient to wet the base ends of the abrasive particles during the heating step and on cooling sufficient to bond the base ends of the abrasive particles within the sintered matrix. For this purpose, it is preferred that the volume be at least 20% based on the total volume of metal particles in the sinterable layer.

Preferred means for optimally orienting the abrasive particles include vibrating the abrasive particles and/or the embossed, perforated, sinterable sheet after the abrasive particles are distributed and held in place by reduced pressure to optimize the abrasive particle orientation. Orienting may also be accomplished by applying a gentle air stream to the particles as they are held in place.

Preferred abrasive particles are selected from substantially cuboctahedral diamond crystals, substantially cuboctahedral cubic boron nitride crystals and various ceramic materials such as alumina-based ceramic material, zirconia-based ceramic material, silicon nitride-based ceramic material and sialon-based ceramic material. Other useful abrasive particles include fused alumina, ceramic alumina, silicon carbide and sol gel-derived alumina based ceramics.

The size of the abrasive particles may be any size useful for the particular application. Preferably the average particle size is in a relatively narrow range to facilitate deposition in the depressions. Preferably the abrasive particle is at least slightly elongated with an aspect ratio of at least 1.5.

The preferred means of temporarily bonding the abrasive particles in the depressions is provided by solvent softening the organic binder so that it bonds to the shaped base end of the abrasive particle and then permitting the solvent to evaporate while continuing to create the differential pressure.

In a further aspect wherein the matrix need not be sintered, the invention provides an abrasive article comprising:

a multiplicity of optimally oriented shaped abrasive particles wherein each abrasive particle has an aspect ratio greater than about 1.5, a shaped base end and an opposite shaped abrading end; and a sheet-like matrix having a top surface which includes depressions wherein substantially each depression contains and binds therein a shaped base end of an abrasive particle while the opposite abrading end of said abrasive particle is exposed and aligned in an optimal orientation.

In a further aspect wherein the matrix is sintered, the invention provides an abrasive article comprising:

a multiplicity of optimally oriented shaped abrasive particles wherein each abrasive particle has a shaped base end and an opposite shaped abrading end;

a sintered sheet-like matrix having a top surface which includes depressions wherein substantially each depression contains and binds therein a shaped base end of an abrasive particle while the opposite abrading end of said abrasive particle is exposed and aligned in an optimal orientation; and a metal foil sinter bonded to the matrix providing a bottom surface to said abrasive article.

The abrasive articles of the invention are characterized by having fewer abrasive particles per unit area as compared to conventional coated abrasive products yet the abrasive products of the invention perform better than or at least equal to such conventional coated abrasive products. Thus, the cost of making the product of the invention is reduced, compared to the cost of making conventional abrasive products, since it typically uses less abrasive material. Moreover, the abrasive performance of the products of the invention may be tailored because the present method affords the opportunity to design an abrasive product with optimal performance.

The various features and advantages of the present invention will become apparent from the following detailed description of preferred embodiments and the accompanying drawings.

DETAILED DESCRIPTION

Figure 1:
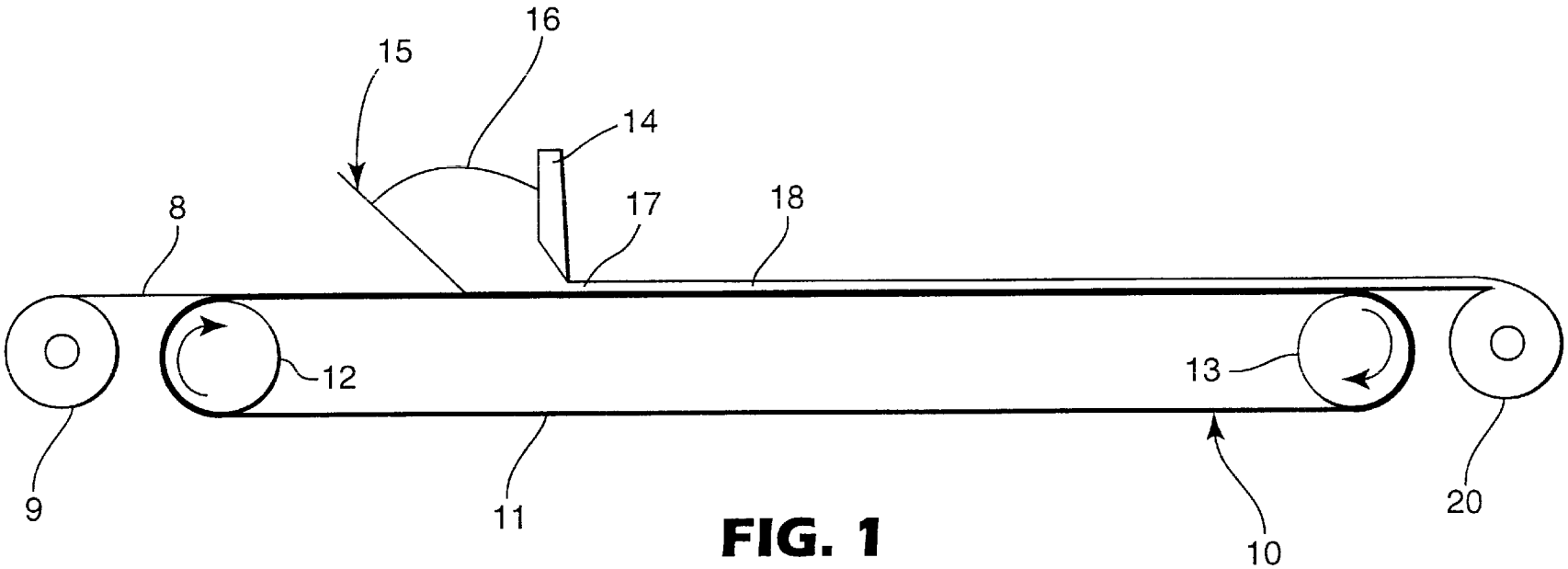
FIG. 1 shows a schematic view of an apparatus and process for making a green tape.

Referring now to FIG. 1, there is shown an apparatus 10 which includes a continuous belt 11 mounted on rollers 12 and 13. Belt 11 may be porous or non-porous, but preferably is non-porous. Belt 11 could have an exposed upper surface of 15 meters or longer and may have associated therewith heating devices such as a tunnel heater, hot air stream or heating element positioned below the upper portion of belt 11 to assist in the drying of coatings applied to the belt. Stainless steel foil 8 from supply roll 9 is conducted over belt 11. Also provided is a knife coating apparatus which includes knife blade 14 which has an edge which is gapped over stainless steel foil 8 to provide a suitable space therebetween to define a coating thickness and a slurry reservoir 15 which contains slurry 16 which passes beneath the edge of knife coater blade 14 to provide a coating 17 of the slurry on stainless steel foil 8 which dries on solvent evaporation to provide green tape 18 borne on metal foil backing 8. The green tape 18/metal foil 8 laminate after drying in air at room temperature or with heating typically has a thickness on the order of 0.05 mm to about 2 mm. The coating thickness of the slurry is typically on the order of 1.5 to 3.5 times (preferably 2 to 3 times) as thick as the desired thickness of the dried green tape, depending on the casting speed and slurry viscosity. Typical casting speeds are on the order of about 5 to 50 cm per minute, preferably about 15 to about 25 cm per minute. After drying, the green tape metal foil laminate is typically wound on a storage roll, such as storage roll 20, also shown in FIG. 2.

Figure 2:
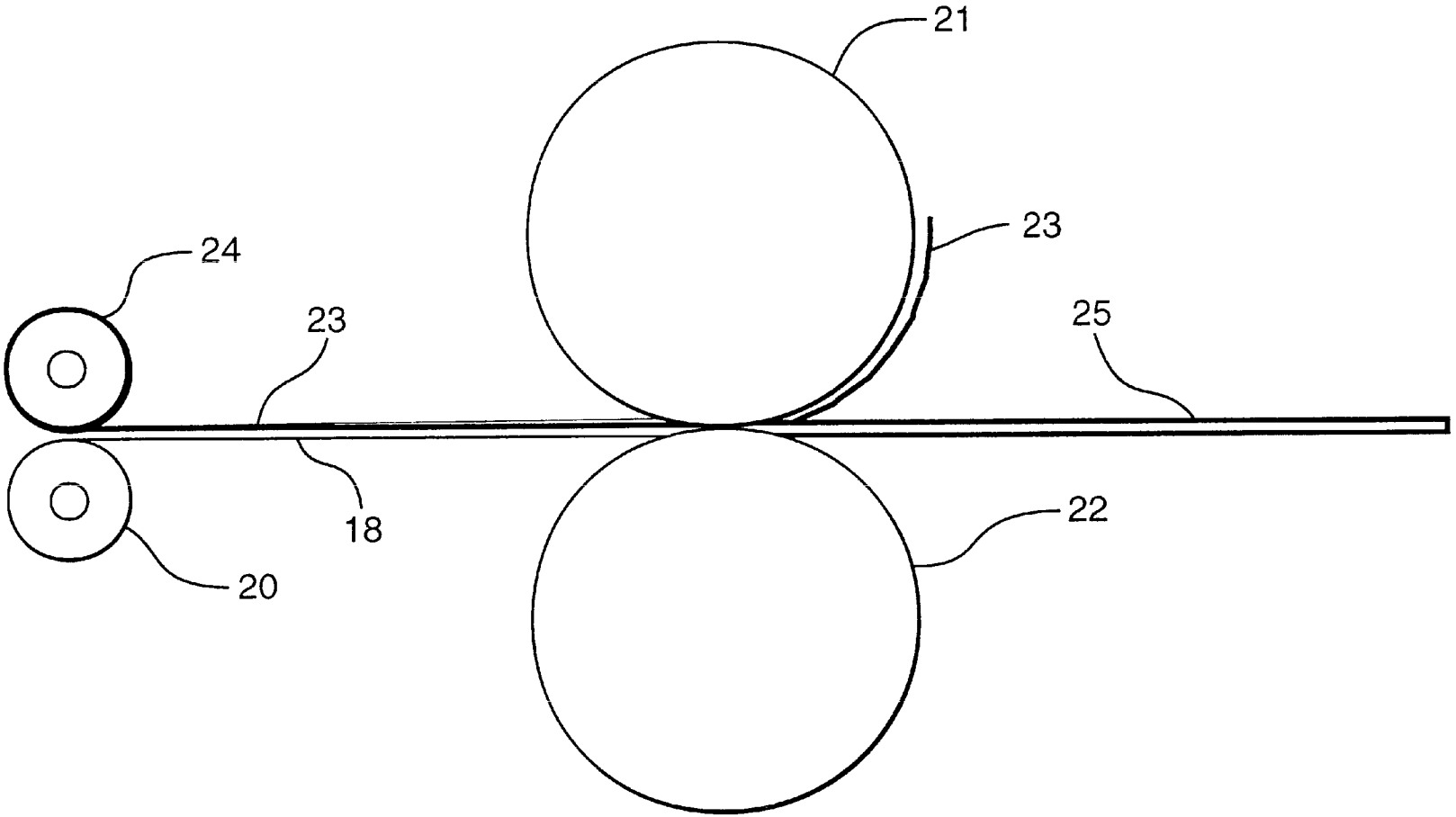
FIG. 2 shows a schematic view of an apparatus and process for embossing a green tape to provide a substrate having perforated depressions.
Figure 3:
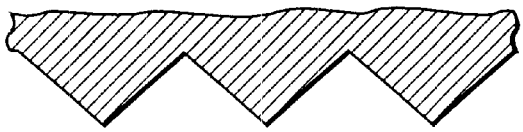
FIG. 3 and FIG. 4, respectively, show in sectional view portions of each of the contact and mating surfaces of the embossing rolls shown in FIG. 2.
Figure 4:
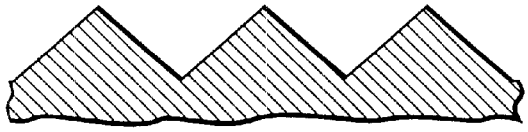
Figure 7:
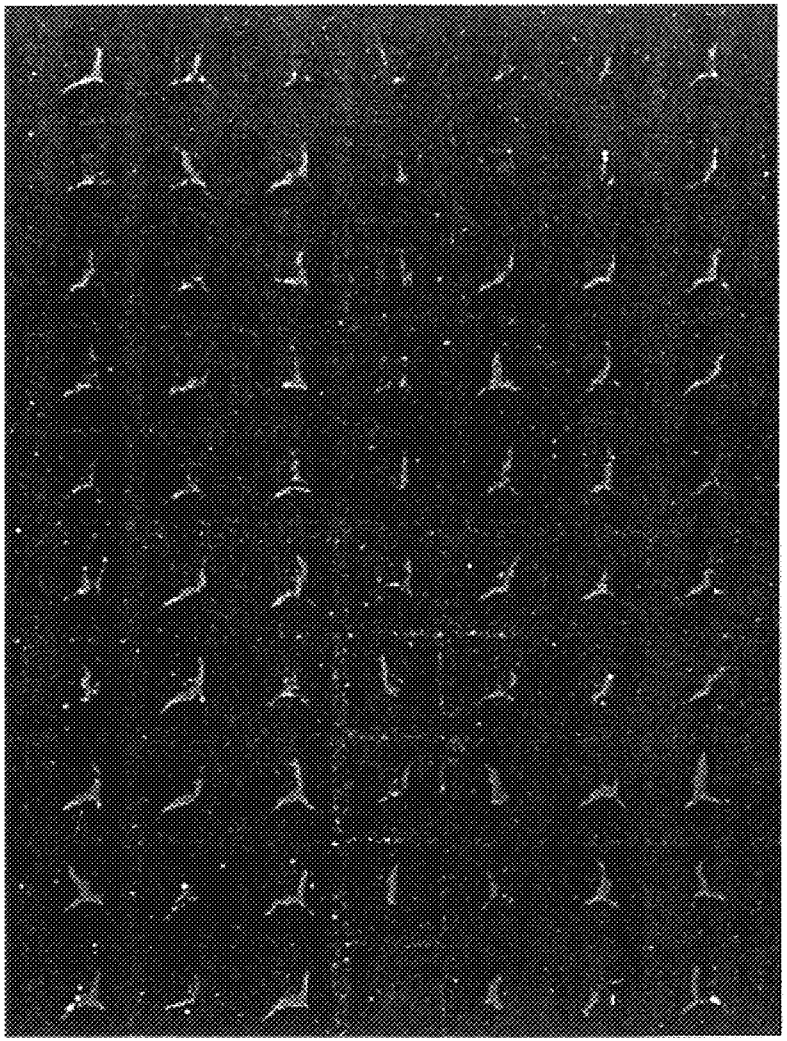
FIG. 7 is a digital reproduction of a photomicrograph taken at a magnification of 15× which shows a top plane view of an actual substrate which has square pyramidal perforated depressions.

FIG. 2 shows an embossing apparatus which includes embossing roll 21 which has a contact surface capable of providing perforated depressions and back up roll 22 which has a mating contact surface capable of forming the perforated depressions. FIGS. 3 and 4, respectively, show greatly enlarged sectional views of portions of the contact surface of back up roll 21 and the mating surface of embossing roll 22. Embossing roll 21 is typically an engraved aluminum roll that has a contact surface which has a close packed array of square pyramids having a 90° angle at their apex. FIG. 3 shows a segment of the contact surface of embossing roll 21 showing these projections in cross sectional view. Each projection is a very small 90° square pyramid with a base end on the roll surface and distal ends which extend upwards from the roll surface to a point. The point may include a smaller further erect projection to perforate the sheet. The square pyramidal features are preferably 1 mm in width and 0.5 mm in height, although smaller or larger dimensions will be used for correspondingly smaller or larger abrasive particles. The mating surface of back up roll 22 has a corresponding array of square pyramidal depressions which, likewise, are the same size, i.e., preferably 1 mm in width and 0.5 mm in depth to match the dimensions of the projections to provide zero gap between the two surfaces. The depressions are shown in cross section in FIG. 4. Each individual depression is actually a square pyramidal depression which is full dimension at the surface of back up roll 22, but tapers to a point within the body of back up roll 22. If the projection includes a smaller further erect projection, the depression may require a further matching smaller depression into which the smaller erect projection would fit. The rolls are typically operated with zero gap. The embossing operation at zero gap typically produces a small tear in the substrate at the bottom of each depression. The embossing operation is carried out by withdrawing green tape 18/metal foil 8 laminate from storage roll 20 and simultaneously withdrawing barrier film 23 from storage roll 24 and drawing the green tape 18 and barrier film 23 simultaneously through the zero tolerance nip between embossing roll 21 and back up roll 22 to produce substrate 25 having perforated depressions corresponding to the pattern borne on the contact surface of embossing roll 21. The top surface of the embossed substrate is shown in the photomicrograph of FIG. 7. The square border of each cell of the substrate defines the boundaries between embossed four sided pyramidal depressions. The openings in the depressions are apparent as lighter areas in the depressions.

Figure 6:
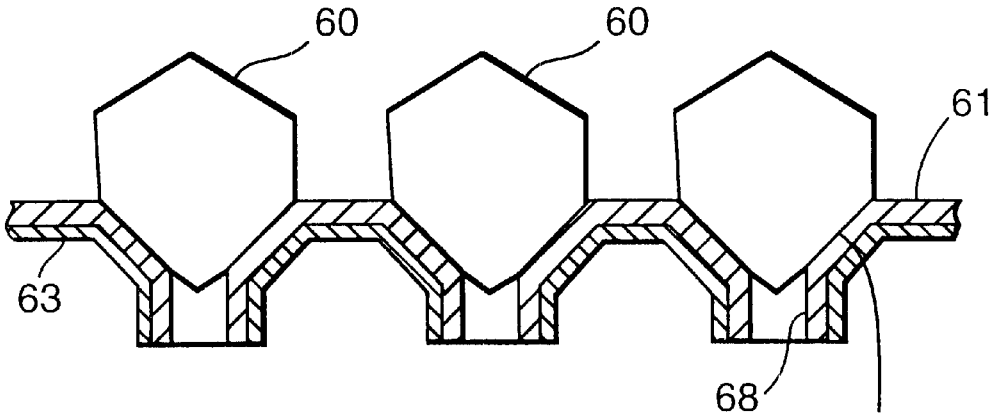
FIG. 6 is a drawing which shows an enlarged representation of diamond particles being deployed in depressions in a substrate.

FIG. 6 shows, for illustrative purposes only, a drawing of an enlarged sectional view of substrate 61 having depressions 62 which include perforations or openings 68 in each depression. The substrate shown in FIG. 6 would not have been made with the embossing tools shown in FIGS. 3 and 4. The embossed substrate 61 is shown with depressions 62 of a size to receive the base ends of abrasive particles 60 such that the abrading end of the particle is erect when the base end of the abrasive particle is seated in its depression 62. Embossed substrate 61 is borne on embossed metal foil 63 with perforations 68 in depressions 62 extending through substrate 61 and metal foil 63.

Figure 5:
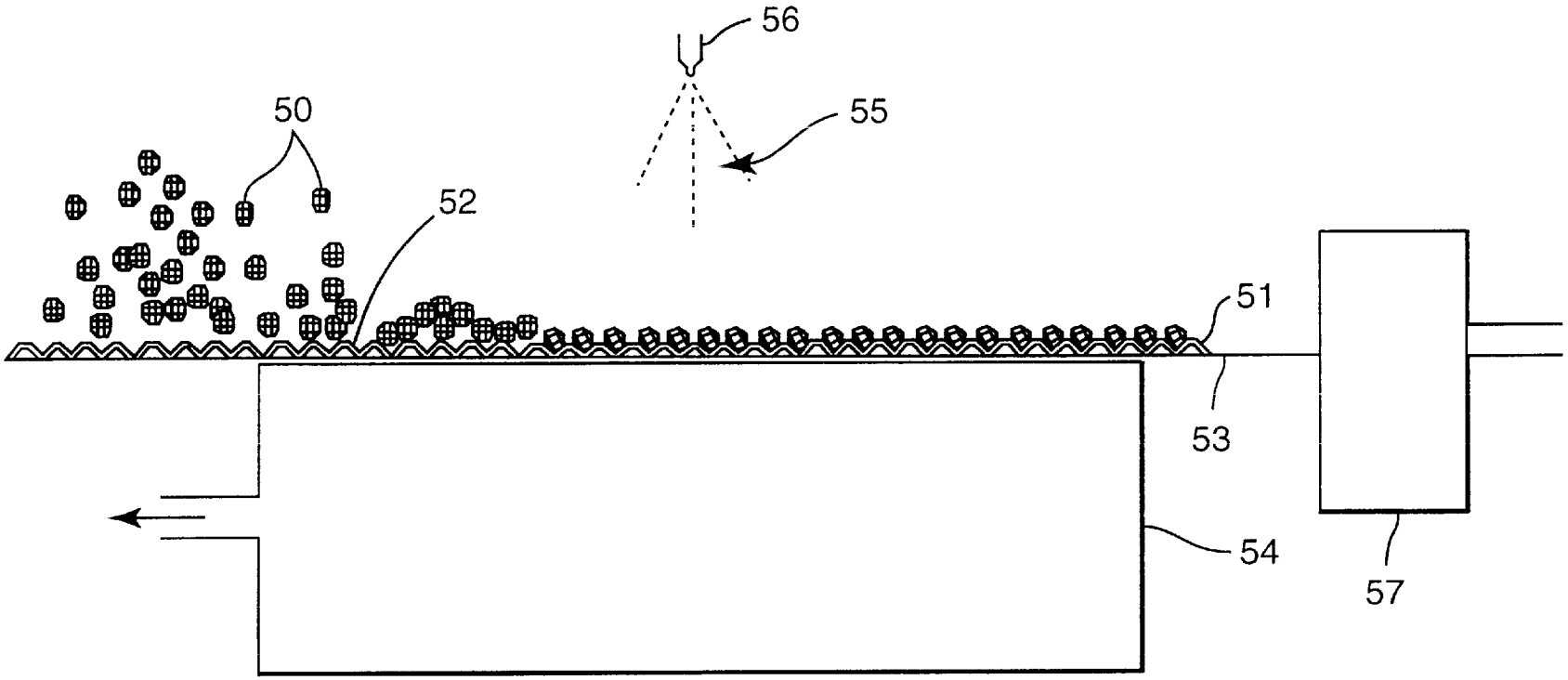
FIG. 5 shows a schematic view of diamond abrasive particles being deposited in the perforated depressions of a substrate and then being subjected to a solvent stream to soften the substrate to adhere the diamond particles within the depressions.

FIG. 5 is a schematic representation of the diamond abrasive particle depositions process wherein diamond abrasive particles 50 are deposited onto the surface of an embossed substrate 51. As shown in FIG. 5, once the abrasive particles are applied to substrate 51, substrate 51 is passed over vacuum chamber 54 to reduce the pressure on the backside of the substrate 51/metal foil 53 laminate to hold the abrasive particles in place. Excess abrasive particles not in depressions are then removed, e.g., by a gentle air stream. Thereafter, a solvent spray 55 is applied to the surface of substrate 51 from an appropriate dispensing device such as a spray nozzle 56 to soften the organic binder component of substrate 51. Vacuum is continued to be applied to the substrate to hold the abrasive particles 50 in place within depressions 52 until the solvent applied to substrate 51 is sufficiently evaporated and thereafter the organic binder forms a temporary bond with the base end of abrasive particle 50 such that it will not be dislodged easily after exiting communication with vacuum chamber 54. The substrate bearing the temporarily bonded abrasive particles is then placed in an appropriate sintering furnace 57. While FIG. 5 shows the substrate bearing the temporarily bonded abrasive particles passing directly into sintering furnace 57, this is typically never the case but merely provided to illustrate that the next phase is the sintering phase of the method. The substrate is typically transported into the furnace in a separate operation.

The substrate bearing the bonded abrasive particles is then heated to drive off the organic binder and fuse the sinterable particles contained in substrate 51 to form a sintered matrix. The surrounding atmosphere during heating may be either oxidizing or non-oxidizing. The abrasive particle-bearing substrate may be first subjected to a pressure of 50–500 kg/cm$^2$ with simultaneous application of heat at temperatures of 800 to 1000° C. (e.g., using a hot press), or it may be placed directly in the sintering furnace at similar temperatures thereby omitting the pressing step.

Figure 8:
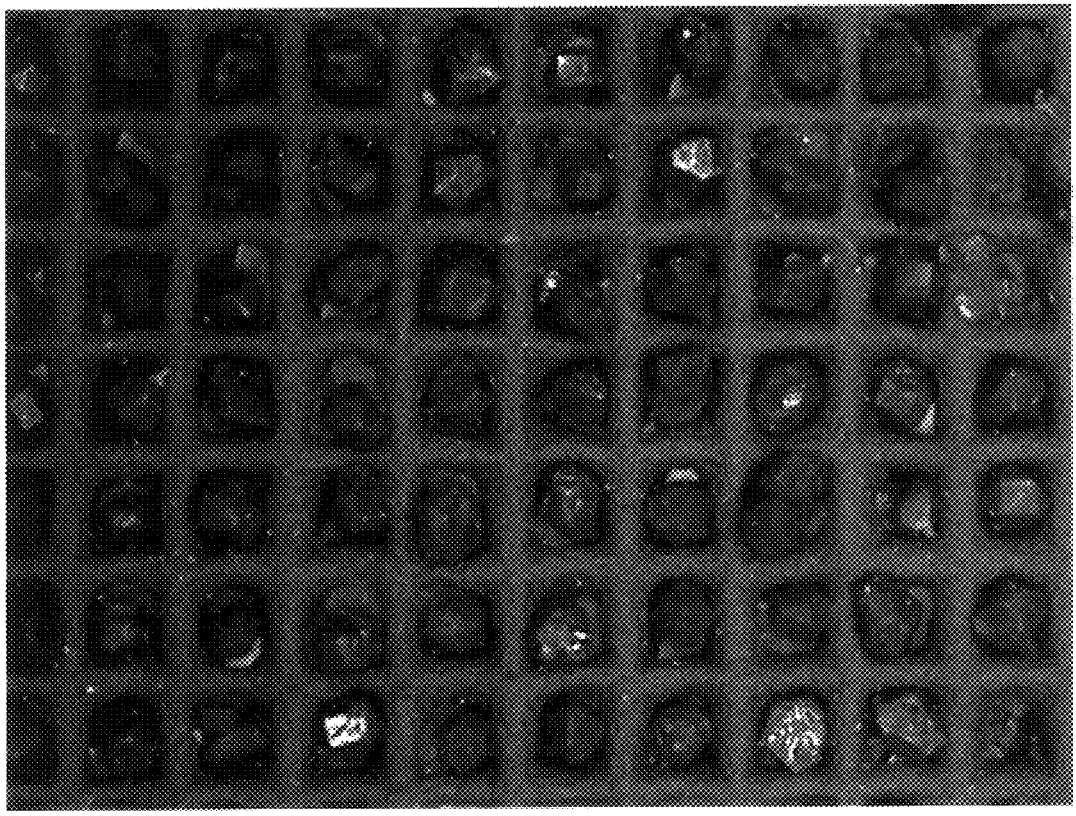
FIG. 8 is a digital reproduction of a photomicrograph taken at a magnification of 15× which shows an abrasive product which includes diamond abrasive particles deployed and bonded in depressions in a sintered substrate in accordance with the present invention.

FIG. 8, a digital reproduction of a photomicrograph of an actual product made in accordance with the invention, includes a matrix, shown in black, which bears in depressions contained therein individual diamond particles which are bonded within the matrix by the process described above. It should be noted that the diamond particles are all optimally oriented with cutting edges deployed in the upright position.

This invention provides a method for positioning and orienting a abrasive particle in one of a multiple of perforated depressions in a substrate and, once deployed, permanently bonding the shaped abrasive particle within a matrix derived from the substrate.

The substrate may be comprised of any sheet-like material which is sufficiently deformable to be endowed with the appropriate depressions which, upon further processing, will convert to a solid intractable material which firmly bonds the base end of the shaped abrasive particle so that the resultant product may be utilized as an abrasive material. The substrate may be a strip or sheet of polymeric material which may be either thermosetting or thermoplastic which, on heating, will bond to the base end of the shaped abrasive particle.

The substrate may also comprise a composition which, on heating, will melt together or sinter to form a metal matrix which firmly adheres therein the base ends of the shaped abrasive particles. If the substrate is a sinterable matrix, it is preferably borne on a thin metal foil which ultimately also becomes bonded to the metal matrix portion of the substrate. Preferred substrates comprise brazing compositions such as an active braze. Useful brazing compositions include Ni—Cr—Si, Cu—Sn, Ag—Cu, Ni—Cr—P, Ni—Cr—Si—B, Ni—Cr—B and Ni—Si—B alloys. Such brazing compositions are readily commercially available. A suitable brazing composition comprises a mixture of Nichrome metal powder (80 weight percent Ni and 20 weight percent Cr) supplied by Atlantic Equipment Engineers, Inc., Bergenfield, N.J. and American Welding Standard product identification designation BNi-7 metal powder (76 weight percent Ni, 14 weight percent Cr, 10 weight percent P) obtained from Wall Colmonoy Company, Madison Heights, Mich. under the trade designation NICROBRAZ 50.

A coating formulation for making a suitable slurry to make a green tape may be provided by a mixture containing 11.2 grams of a mixture of 60 volume percent methyl ethyl ketone and 40 volume percent ethanol, 0.5 gram fish oil available under the trade designation Z-3 BLOWN MENHADEN fish oil from TCW Company, Morrisville, Pa., 2 grams poly (vinyl butyral-co-vinyl alcohol-co-vinyl acetate) ($M_w$=34,000 g/mol, obtained from Aldrich Chemical Company, Milwaukee, Wis. under catalogue number 19,097-7), 0.4 gram UCON lubricant obtained from Union Carbide Corporation, Danbury, Conn. under catalogue number 50-HB-2000, 0.4 gram dioctyl phthalate plasticizer available under the trade designation "DOP" from Aldrich Chemical Company, Milwaukee, Wis., 60.34 grams Nichrome metal powder (80 weight percent Ni, 20 weight percent Cr) powder obtained from Atlantic Equipment Engineers, Inc., Bergenfield, N.J. and 25.86 grams Bni-7 metal powder (76 weight percent Ni, 14 weight percent Cr, 10 weight percent P) obtained from Wall Colmonoy Company, Madison Heights, Mich. These ingredients are charged into a 25 mL plastic jar with 250 grams of steel balls (125 grams of 9.6 mm balls and 125 grams of 6.3 mm balls) and the mixture and balls are rotated in a suitable device at 100 rpm for 24 hours. Thereafter, the resulting slurry is separated from the stainless steel balls and transferred to a 125 mL plastic bottle which is then slowly rotated at a speed of one rpm to eliminate air bubbles.

The thin metal foil portion of the substrate including the sinterable element preferably is less than 100 $\mu$m in thickness, more preferably from about 25 up to 50 $\mu$m, to facilitate deformation of the substrate to provide the perforated depressions.

The substrates containing the sinterable material and metal foil may be produced by conventional tape casting techniques. One example of a tape casting technique utilizes a coating apparatus such as a doctor blade or knife blade to coat a slurry of sinterable powder such as metal powder, organic binder and liquid vehicle, if needed, onto a metal foil and, once dried, a green tape on metal foil is produced. Another example of a tape casting technique utilizes a coating apparatus such as a doctor blade or knife blade to coat a slurry of sinterable powder such as metal powder, organic binder and liquid vehicle, if needed, onto a release liner, removing solvent by evaporation to create a green tape on a release liner which may be laminated to a thin metal foil to produce a green tape on metal foil.

The liquid vehicle is typically a solvent for the organic binder material. The ingredients, i.e., sinterable particles, organic binder and solvent are selected to obtain a coatable viscosity for the slurry. The viscosity is preferably in the range from about 2,000 to 3,000 cps, as determined under ambient conditions using a Brookfield viscometer fitted with a number 3 spindle at 100 rpm. The ingredients are typically milled in a ball mill to obtain a smooth coatable composition. If the viscosity of the slurry is too low after milling, the viscosity may be increased by removal of a portion of the solvent prior to tape casting. Typically, solvent is removed from the slurry by evaporation during mixing. The green sheet is typically first cast onto a carrier support, then carefully dried to produce an uncracked, unwarped green tape-like article. Drying may be accomplished by using any of several conventional liquid removal techniques including heating. Preferably, the green tape is dried in air at room temperature or heated in air at a temperature in the range of about 30° C. to about 50° C. The thickness of the green tape after drying is typically in the range of about 0.05 mm to about 2 mm. The sinterable particles in the slurry which is coated to make the green tape are preferably components of a brazing composition.

The metal foil may be composed of any thin metallic material but preferably is composed of nickel 200 or stainless steel, preferably 304 stainless steel. The metal foil preferably has a thickness of less than 100 micrometers, preferably from about 25 to 50 micrometers, most preferably about 20 to 30 micrometers.

The slurry containing the sinterable particles, organic binder and solvent, preferably includes a plasticizer such as dioctyl phthalate to make the green sheet less brittle and more easily conformable during the forming operation. Useful plasticizers for this purpose include glycols such as polyethylene glycol; glycerols such as glycerol and diethylene glycerol; alkyl esters such as dioctyl phthalate, butyl benzyl phthalate, dibutyl phthalate, dibutyl sebacate, and the like; oils such as paraffinic oils and aromatic oils, and the like; ethers such as dibenzyl ether, and the like; phosphates such as triphenyl phosphate, tritolyl phosphate, and the like. The amount of plasticizer contained in the dried green structure preferably is less than about 5 percent by weight based upon the weight of sinterable particles, most preferably less than about 3 percent by weight and preferably from about 1 to 3 percent by weight. The preferred ratio of organic binder to plasticizer is about 4:1 to about 6:1, most preferably about 5:1.

The weight percent of organic binder, based on the total weight of sinterable particles in the dried green structure, is preferably on the order of 2 to 10 percent, most preferably 3 to 6 percent.

Useful binders include, but are not limited to, plasticized and unplasticized thermoplastic resins such as polyesters, acrylic polymers, methacrylic polymers, ethylene vinyl acetate copolymers, polyurethanes, polyamides, ureaformaldehydes, polyolefins including polyalphaolefins such as polyethylene and polypropylene, polyvinyl acetals such as polyvinyl butyral, styrenic polymers including copolymers such as styrene-butadiene-styrene block copolymers, cellulosic polymers such as carboxy-methyl cellulose or cellulose acetate and the like; and plasticized non-thermoplastic resins such as plasticized polyvinyl alcohols, plasticized acrylic copolymer latex emulsions, plasticized polyvinyl pyrrolidone polymers; or any polymer that is solvent soluble and pyrolyzable to a negligible residue.

The dried green tape may be preferably coated with a light layer of wax or heat activatable adhesive on its top surface before it is deformed by the substrate forming apparatus. A thin metal or polymer sheet is then placed on top of the wax layer to act as a separation barrier between the dried green tape and the tool surface. The composite sheet and barrier layer are then rolled between the contact surface of the first tool and the mating surface of the second tool. The contact surface of the first tool includes a multiplicity of projections which are capable of deforming the substrate to provide perforated depressions in the substrate. The perforated depressions in the substrate are of a size capable of receiving in each depression one base end of the abrasive particle and are shaped to optimally orient the abrasive particle in the depression. That is, the depression has a conical shape or a rectangular pyramid shape which will cause the base end of the abrasive particle to be deployed downward and the opposite abrading end of the particle to be deployed in a substantially upright position. A preferred conical shape is a 120° cone. The size of the abrasive particles will dictate the size of the depressions in the substrate. Smaller abrasive particles will require smaller depressions and the larger abrasive particles will require correspondingly larger depressions. The substrate is perforated within each depression to provide a pathway for applying a pressure differential between the upper surface of the substrate bearing the abrasive particles and the lower surface of the substrate. This is easily accomplished by drawing a vacuum on the bottom side of the substrate while the abrasive particles are in place which, in effect, causes the abrasive particles to be temporarily immobilized so that they will not easily be removed during subsequent operations until they are permanently bonded within the depressions.

After the substrate is formed in the substrate forming apparatus, abrasive grains are sprinkled over the surface of the substrate so that substantially each depression is filled with only one abrasive particle. It is not uncommon in the method to find an occasional additional abrasive particle next to an abrasive particle seated in a depression. Thereafter, the vacuum is applied to the back surface of the substrate while simultaneously optimally orienting the abrasive grains in the depressions. Such optimal orientation may be accomplished by vibrating either the abrasive particles or the substrate or by squeegeeing, blowing or otherwise relocating the particles into the depressions in the substrate. After all the depressions are filled, excess particles are removed by a suitable means, typically by a gentle air flow which is not so great as to cause the particles within the depressions to be ejected therefrom.

Thereafter, the abrasive particles that are being held in the depressions of the substrate are temporarily bonded therein by heating either the wax or heat activatable adhesive.

An alternative preferred method of temporarily bonding the abrasive particles within the depressions is by spraying the upper surface of the substrate with a solvent for the organic binder material of the substrate which will soften the organic binder sufficiently so that it becomes tacky and forms a temporary adhesive bond with the base end of the abrasive particles, then continuing to draw vacuum on the softened organic binder until sufficient solvent is removed from the organic binder to cause a more permanent bond between the base end of the abrasive particles and the substrate. Suitable solvents will be selected depending on the type of organic binder materials in the substrate.

The substrate bearing the abrasive particles is then placed into a suitable oven to heat the substrate to cause organic binder removal and then sintering of the sinterable particles in the substrate. The sinterable particles should provide a sufficient liquid volume to encompass the base ends of the abrasive particles such that, when cooled, a strong adherent bond forms between the matrix formed by the sintered particles and the base ends of the abrasive particles.

This invention allows the production of oriented particles for abrasive articles. The further improvement of cutting with diamonds oriented with the sharp edges and points aligned permits the reduction of diamond content for equivalent diamond performance. This may result in a substantial raw material cost savings. Previous methods placed the abrasive particles in a spatial array, but do not orient their geometry to maximize cutting efficacy. Prior methods also typically require the use of a batch hot pressing operation to develop a sufficient bond and tape microstructure. The hot pressing may cause a rotation of abrasive particles to a less desirable orientation. While the present invention may utilize hot pressing during sintering, one aspect of the invention is a pressureless sintering process, which may be performed in a semi-continuous manufacturing process. The transition from a batch process to a semi-continuous process may significantly reduce the manufacturing costs of tapes. This invention uses sintering temperatures, environments and compositions specifically designed to be compatible with pressureless sintering. This invention produces a semi-finished abrasive composite tape which may be sold to a tool manufacturer or used to produce tools.

EXAMPLES

The invention is further illustrated by the following examples wherein all parts and percentages are by weight unless otherwise indicated.

Preparation of Green Tape Formulation 1

A 250 mL plastic jar was charged with about 250 grams of stainless steel balls (125 g of 9.6 mm balls and 125 g of 6.3 mm balls), 11.2 g of a mixture of 60 volume percent methyl ethyl ketone with 40 volume percent ethanol, 0.5 g fish oil (available under the trade designation Z-3 BLOWN MENHADEN fish oil from TCW Co., Morrisville, Pa.), 2 g poly(vinyl butyral-co-vinyl alcohol-co-vinyl acetate) ($M_w$= 34,000 g/mol, Cat. No. 19,097-7, Aldrich Chemical Co., Milwaukee, Wis.), 0.4 g lubricant (available under the trade designation UCON as Cat. No. 50-HB-2000, from Union Carbide Corp., Danbury, Conn.), 0.4 dioctyl phthalate (available under the trade designation "DOP" from Aldrich Chemical Co., Milwaukee, Wis.), 60.34 g Nichrome metal powder (80 wt. % Ni and 20 wt. % Cr powder supplied by Atlantic Equipment Engineers, Inc., Bergenfield, N.J.), and 25.86 g BNi-7 metal powder (76 wt. % Ni-14 wt. % Cr-10 wt. % P purchased from Wall Colmonoy Co.).

The ingredients were ball milled at a speed of about 100 rpm for about 24 hours. The resulting slurry was separated from stainless steel balls and then transferred to a 125 mL plastic bottle. The slurry containing bottle was slowly rolled at a speed of one rpm to eliminate air bubbles.

Preparation of Green Tape Formulation 2

A 250 mL plastic bottle was charged with about 125 g of 9.6 mm stainless steel balls and 125 g of 6.3 mm stainless steel balls, 11.2 g of a mixture of 60 volume percent methyl ethyl ketone with 40 volume percent ethanol, 0.5 g fish oil, 2.0 g of polyvinyl butyral, 0.4 g 2000 g/mole polyethylene glycol available under the trade designation CARBOWAX from Union Carbide Co., Danbury, Conn., 60.34 g Nichrome metal powder, and 25.86 g BNi-7 metal powder.

The ingredients were ball milled at a speed of about 100 rpm for about 24 hours. The resulting slurry was separated from stainless steel balls, transferred to a 125 mL plastic bottle and then slowly rolled at a speed of one rpm to eliminate air bubbles.

Preparation of Green Tape Formulation 3

A 125 mL plastic bottle was charged with about 125 g of stainless steel balls (50/50 wt % of 9.6 mm and 6.3 mm balls), about 5.6 g of a mixture of 60% by volume methyl ethyl ketone with 40% by volume ethanol, 1.0 g poly(vinyl butyral-co-vinyl alcohol-co-vinyl acetate) ($M_w$=34,000 g/mol, Cat. No. 19,097-7, Aldrich Chemical Co., Milwaukee, Wis.), 0.4 g butyl benzyl phthalate available under the trade designation SANTICIZER 160 from Monsanto Corp., St. Louis, Mo.), 30.17 g of Nichrome metal powder, and 12.93 g BNi-7 metal powder.

The ingredients were ball milled at a speed of about 100 rpm for about 24 hours. The resulting slurry was separated from stainless steel balls, transferred to a 125 mL plastic bottle and then slowly rolled at a speed of one rpm to eliminate air bubbles.

Green Tape Formation

Green tape formulations 1–3 were cast from solution using a doctor blade to regulate the tape thickness such that, after drying, a tape thickness of approximately 100 micrometers was obtained.

Microforming Procedure

Microforming was accomplished by passing the green tape article to be microformed (e.g., foil or green tape) between a set of matched male and female engraved aluminum rolls. The aluminum rolls had a close packed array of square pyramids having a 90° angle at the apex. The square pyramidal features were 1 mm in width and 0.5 mm deep for the female roll and 1 mm in width and 0.5 mm high for the male roll. Microforming was carried out at zero gap between the rolls, but there was sufficient play in the mechanism to allow the substrate to pass through the rolls without jamming. Unless otherwise specified sufficient pressure was applied to the rolls that perforation of the microformed features occurred.

Example 1

A nickel 200 25.4 $\mu$m thickness foil was coated with melted paraffin wax (white refined paraffin wax from McMaster-Carr Supply Company, Aurora, Ohio, coated at <0.1 mm coating thickness) using a cotton swab. The wax side of the foil was placed toward the male engraved roll and the foil was passed between the engraved rolls at sufficient pressure such that perforation of the embossed features occurred resulting in a perforated foil approximately 13 cm×13 cm square. The perforated, microformed foil was placed female side up onto a 14-mesh sieve (1.4 mm opening) for mechanical support.

Approximately 25 g of industrial cuboctahedral diamonds (De Beers Consolidated Mines, Ltd., Kimberly, South Africa) sieved at less than 20 mesh (0.84 mm opening) but greater than 30 mesh (0.60 mm opening) were sprinkled onto the wax layer of the nickel 200 foil. A 10 cm diameter funnel was attached to the hose of a vacuum cleaner (SHOP-VAC model no. 5130-60 vacuum cleaner from Shop-Vac Corp., Williamsport, Pa.) and placed beneath a 14-mesh sieve. The vacuum was applied while the sieve was gently shaken and a gentle air pressure was applied to move the diamonds into the female diamond recesses. After most the diamonds were in place, the foil was removed from the sieve and placed on a hot plate to melt the wax coating on the foil beneath the diamonds. The foil was allowed to cool whereby the wax solidified and the diamonds were temporarily fixed into place.

A gentle bristle brush was used to remove diamonds that were not securely affixed to the foil. Green Tape Formulation 1 was cast into a tape of approximately 0.2 mm to 0.3 mm thickness which was laminated to bottom face of the diamond embedded perforated foil and the combination was mounted onto a 304 stainless steel disk (11 cm diameter by 0.5 cm thick). This construction was placed into a resistance-heated furnace with an inert gas retort. Argon was introduced through the retort at a flow of 1 to 5 standard liters per minute. The furnace was heated at a rate of 500° C. per hour to a temperature of 950° C. and held for one hour before furnace cooling to room temperature resulting in a single layered sintered diamond abrasive pad conditioner.

Example 2

The procedure of Example 1 was repeated except for the indicated changes. Green Tape Formulation 3 was cast directly onto the backside (male) of a microformed nickel 200 foil (25 $\mu$m thickness). This allowed a more direct contact of the powder metal brazing agent to come in contact with the diamond. The perforations were exposed by light abrading with a 200 grit SiC sandpaper (Minnesota Mining and Manufacturing Company, St. Paul, Minn.). Diamonds were applied and sintered without applied pressure to give a single layered sintered diamond abrasive pad conditioner.

Example 3

The procedure of Example 1 was repeated except for the indicated changes. Green Tape Formulation 2 was cast onto stainless steel foil (25 micrometer thickness) which was subsequently microformed. The result was a single layered sintered diamond abrasive pad conditioner.

Example 4

The procedure of Example 1 was repeated except for the indicated changes. Green Tape Formulation 1 was sandwiched between a ductile metal foil (25 $\mu$m thickness, nickel 200) and a brittle metal foil (25 μm thickness, cold rolled 302 stainless steel). The nickel 200 foil side was placed against the female roll and the 302 stainless steel foil side was placed against the male roll and the tape was microformed. The 302 stainless steel foil easily perforated and then separated from the green tape. Diamonds were applied to the exposed green tape surface and the laminate was mounted on a 304 stainless steel disc and processed as before to give a single layered, sintered diamond abrasive pad conditioner.

Example 5

The procedure of Example 1 was repeated except for the indicated changes. No wax coating was applied to the surface of the green tape. Green Tape Formulation 1 was sandwiched between layers of plastic film available under the trade designation SARAN from Dow Chemical Corp., Midland Mich. to facilitate separation of the green tape from the tool. A flat tool was used with square pyramidal features with an apex angle of 90° and a base of 0.5 mm. Each pyramidal feature had a conical post attached to the top of the apex approximately 0.05 mm wide and 0.1 mm long. The features were arranged in a square array at a spacing of 0.75 mm from center to center. A thin polymer sheet such as 0.25 mm thick polyethylene was placed beneath the sandwiched green tape. The tool with male pyramid features plus sharp conical posts was placed sharp side down, so as to be in contact with the sandwiched green tape. In a separate procedures, this assembly was placed in a uniaxial press with platens heated to between 20° C. and 80° C. depending on the composition and volume of the organic binder. Pressures ranging from 3 MPa to 20 MPa was used to perforate and form microstructure in the green tape. Diamonds were applied and the excess diamonds removed as described in Example 1, however the positioned diamonds were affixed into the green tape recesses by spraying a light mist of 30 volume percent methyl ethyl ketone and 70 volume percent isopropyl alcohol, while applying the vacuum. The solvent partially dissolved the organic binder and adhered the diamonds in place. The green tape was placed on a clean 304 stainless steel plate and sintered as described in Example 1 to produce a pad conditioning article.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

What is claimed is:

1. A method of making an abrasive article comprised of a matrix having the form of a sheet or strip, the matrix having deployed therein a multiplicity of optimally oriented shaped abrasive particles, each abrasive particle having a shaped base end and an opposite shaped abrading end, said method comprising the following steps:

a) providing a substrate forming apparatus including a first tool having a contact surface including a multiplicity of projections and a second tool having a mating surface;

b) providing an embossable, perforatable, sinterable substrate having the form of a sheet or strip, the substrate comprised of a metal foil having a layer of sinterable particles and an organic binder thereon;

c) contacting the substrate with the contact and mating surfaces of said first and second tools to provide an embossed, perforated, sinterable sheet having back surface provided by said metal foil and an opposite top surface characterized by having a multiplicity of tapered depressions, and a perforation through the substrate within said depression;

d) deploying one abrasive particle within each of said depressions;

e) orienting each abrasive particle in the depression containing the abrasive particle, such that the abrading ends of the abrasive particles are exposed;

f) creating a pressure differential between the top surface and the back surface of said embossed, perforated, sinterable sheet wherein a lower pressure is applied to the back surface to hold each oriented abrasive particle within its depression while removing at least a major portion of the abrasive particles not within said depressions from the top surface of said embossed, perforated, sinterable sheet;

g) temporarily bonding said abrasive particles in said depressions after they are oriented;

h) heating the embossed, perforated, sinterable sheet having abrasive particles within the depressions thereof at a sintering temperature to provide on cooling an abrasive product which includes a sintered matrix bonded to shaped abrasive particles with abrading ends exposed; and i) cooling said abrasive product.

2. The method of claim 1, wherein each of the contact and mating surfaces of said tools correspond to the surface of a roller.

3. The method of claim 1, wherein said sinterable particles comprise metal particles.

4. The method of claim 3, wherein said layer provides on heating to the sintering temperature a liquidus phase in a volume sufficient to wet the base ends of said abrasive particles during the heating step and on cooling sufficient to bond the base ends of said abrasive particles within said sintered matrix.

5. The method of claim 4, wherein said volume is at least 20% based on the total volume of metal particles in the layer.

6. The method of claim 1, wherein in step e) orienting comprises vibrating.

7. The method of claim 1, wherein said abrasive particles are selected from cuboctahedral diamond crystals or cuboctahedral cubic boron nitride crystals.

8. The method of claim 3, wherein said metal particles are at least partially comprised of a brazing composition.

9. The method of claim 8, wherein said brazing composition comprises an active metal braze.

10. The method of claim 8, wherein said brazing composition is selected from Ni—Cr—Si, Cu—Su, Ag—Cu, Ni—Cr—P, Ni—Cr—Si—B, Ni—Cr—B or Ni—Si—B alloys.

11. The method of claim 1, further comprising the step of solvent softening the organic binder prior to deploying the abrasive particles.

12. An abrasive article comprising:

a) a multiplicity of shaped abrasive particles wherein each abrasive particle has a shaped base end and an opposite shaped abrading end;

b) a sintered matrix having the form of a sheet or strip, the matrix having a top surface which includes depressions wherein each depression contains and binds therein a shaped base end of an abrasive particle while the opposite abrading end of said abrasive particle is exposed and aligned in an optimal orientation; and c) a metal foil sinter bonded to the matrix providing a bottom surface to said abrasive article.

13. The abrasive article of claim 12, wherein said abrasive particles are cuboctahedral diamond crystals.

14. The abrasive article of claim 12, wherein said abrasive particles are cuboctahedral cubic boron nitride.

15. The abrasive article of claim 12, wherein said sintered matrix comprises a metal alloy braze.

16. A method of making an abrasive article comprised of a matrix having the form of a sheet or strip, the matrix having deployed therein a multiplicity of optimally oriented shaped abrasive particles, each abrasive particle having a shaped base end and an opposite shaped abrading end, said method comprising the following steps:

a) providing a substrate forming apparatus including a first tool having a contact surface including a multiplicity of projections and a second tool having a mating surface;

b) providing an embossable, perforatable, substrate having the form of a sheet or strip;

c) contacting the substrate with the contact and mating surfaces of said first and second tools to provide an embossed, perforated, sheet having back surface and an opposite top surface characterized by having a multiplicity of tapered depressions and a perforation through the substrate within said depression;

d) deploying one abrasive particle within each of said depressions;

e) orienting each abrasive particle in the depression containing the abrasive particle, such that the abrading ends of the abrasive particles are exposed;

f) creating a pressure differential between the top surface and the back surface of said embossed, perforated sheet wherein a lower pressure is applied to the back surface to hold each oriented abrasive particle within its depression while removing at least a major portion of the abrasive particles not within said depressions from the top surface of said embossed, perforated sheet; and g) permanently bonding said abrasive particles in said depressions after they are oriented to provide an abrasive product which includes optimally oriented shaped abrasive particles with abrading ends exposed.

17. The method of claim 16, wherein each of the contact and mating surfaces of said tools correspond to the surface of a roller.

18. The method of claim 16, wherein said abrasive particles are optimally oriented by vibrating the abrasive particles and/or the embossed, perforated sheet after the abrasive particles are distributed to optimize the abrasive particle orientation.

19. The method of claim 16, wherein said abrasive particles are selected from the group consisting of fused alumina, ceramic alumina, silicon carbide, sol gel-derived alumina based ceramics, diamond and cubic boron nitride.

20. An abrasive article comprising:

a) a multiplicity of shaped abrasive particles wherein each abrasive particle has an aspect ratio greater than about 1.5, a shaped base end and an opposite shaped abrading end; and b) a matrix having the form of a sheet or strip, the matrix having a top surface which includes tapered perforated depressions, wherein each depression contains and binds therein a shaped base end of an abrasive particle while the opposite abrading end of said abrasive particle is exposed.

21. The abrasive article of claim 20, wherein said abrasive particles are selected from the group consisting of CBN, diamond crystals, cubic boron nitride, fused alumina, ceramic alumina, silicon carbide, and sol gel-derived alumina based ceramics.

22. The abrasive article of claim 20, wherein said abrasive particles are comprised of a ceramic material.

23. The abrasive article of claim 22, wherein said ceramic material is selected from the group consisting of alumina-based ceramic material, zirconia-based ceramic material, silicon nitride-based ceramic material and sialon-based ceramic material.

24. The abrasive article of claim 20, wherein said matrix comprises a thermal or UV cured polymeric resin.

25. The method of claim 1, wherein said second tool comprises a flexible sheet having a mating surface which is smooth.

26. The method of claim 16, wherein said second tool comprises a flexible sheet having a mating surface which is smooth.

27. The method of claim 1, wherein said heating step is carried out while applying pressure to the abrasive particles and embossed perforated sheet.

28. The method of claim 16, wherein said permanent bonding is accomplished while applying heat and pressure to the abrasive particles and embossed perforated sheet.

29. A tool including an element comprising the abrasive article defined in claim 12.

30. A tool including an element comprising the abrasive article defined in claim 20.

* * * * *